US012446706B1

(12) United States Patent
Lai

(10) Patent No.: US 12,446,706 B1
(45) Date of Patent: Oct. 21, 2025

(54) BED SHEET HOLDER

(71) Applicant: Guanqin Lai, Guangdong (CN)

(72) Inventor: Guanqin Lai, Guangdong (CN)

( * ) Notice: Subject to any disclaimer, the term of this patent is extended or adjusted under 35 U.S.C. 154(b) by 0 days.

(21) Appl. No.: 19/085,052

(22) Filed: Mar. 20, 2025

(51) Int. Cl.
*A47C 21/02* (2006.01)

(52) U.S. Cl.
CPC ..... *A47C 21/022* (2013.01)

(58) Field of Classification Search
CPC ... A47C 21/028; A47C 21/026; A47C 27/085; A47C 21/024; A47C 21/022
USPC ..... 5/504.1
See application file for complete search history.

(56) References Cited

U.S. PATENT DOCUMENTS 5,218,729 A * 6/1993 Walton ..... A47C 21/026 5/658
5,342,110 A * 8/1994 Merrick ..... A47C 1/12 52/9
D560,485 S * 1/2008 Lavelle ..... D8/402
D573,013 S * 7/2008 Lavelle ..... D8/403
8,522,376 B2 * 9/2013 Rohr ..... A47C 21/026 5/692
9,854,920 B1 * 1/2018 Welborn ..... A47C 21/022
D1,012,548 S * 1/2024 Stevens ..... D6/562
D1,062,309 S * 2/2025 Lewis ..... D6/607
D1,070,423 S * 4/2025 Yang ..... D6/607
2011/0308014 A1 * 12/2011 Hayun ..... A47C 21/022 5/498
2019/0261779 A1 * 8/2019 deVilleneuve ..... A47C 21/022
2025/0057323 A1 * 2/2025 Cano ..... B32B 27/06
2025/0098868 A1 * 3/2025 Lewis ..... A47C 21/022

* cited by examiner

*Primary Examiner* — Myles A Throop

(57) ABSTRACT

A bed sheet holder includes a bracket and sleeving members. The bracket includes a bottom plate, supporting members arranged on the bottom plate, and first sliding blocks arranged on the supporting members. A first sliding slot is defined in the sleeving member. At least one end of the first sliding slot is a first opening. The first sliding block is arranged inside the first sliding slot. When the bracket is used in conjunction with a bed sheet, the bottom plate is pressed under a mattress, the supporting member is attached to an outer side wall of the mattress, the first sliding block is exposed on an outer side of the mattress, and the sleeving member is sleeved on the first sliding block through the first sliding slot, thereby pressing one part of the bed sheet between the sleeving member and the first sliding block to fix the bed sheet.

18 Claims, 4 Drawing Sheets

BED SHEET HOLDER

TECHNICAL FIELD

The present invention relates to the technical field of daily necessities, particularly to a bed sheet holder.

BACKGROUND ART

A bed sheet holder is used for fixing a bed sheet and preventing the bed sheet from moving when people turn over while sleeping to affect their sleep. At present, existing bed sheet holders generally include a bracket and a strip-shaped sheet body. The bracket includes a bottom plate, two spaced supporting members extending upward from the bottom plate, and first sliding slots defined in the supporting members. When the bed sheet holder is used, the bottom plate is pressed on a bottom portion of a mattress, and the two supporting members are respectively attached to two adjacent side surfaces of the mattress. At this time, the bed sheet covers the bracket, and the strip-shaped sheet body is inserted into the first sliding slot on the two supporting members, so as to press the bed sheet between the strip-shaped sheet body and the first sliding slot. However, when the bed sheet holder is used for fixing the bed sheet, and when the bed sheet is pulled, the strength of the strip-shaped sheet body is low, and the strip-shaped sheet body is easy to be pulled apart, thus affecting the user experience. In addition, the length of the strip-shaped sheet body is relatively long, which can easily increase transportation costs.

SUMMARY

The main purpose of the present invention is to provide a bed sheet holder. This is to solve the problems of increased transportation costs and the ease of being pulled apart due to a long length of a strip-shaped sheet body in an existing bed sheet holder that uses the strip-shaped sheet body in combination with a bracket to fix a bed sheet.

In order to solve the above technical problems, the technical solution provided in the present invention is as follows.

A bed sheet holder includes a bracket and a plurality of sleeving members.

The bracket includes a bottom plate, a plurality of supporting members arranged on the bottom plate, and a plurality of first sliding blocks arranged on the supporting members.

A first sliding slot is defined in the sleeving member. At least one end of the first sliding slot is a first opening. The first sliding block is arranged inside the first sliding slot.

Furthermore, a total number of the sleeving members and a total number of the first sliding blocks are both multiple. Each of the sleeving members is used in conjunction with one of the first sliding blocks. At least two of the first sliding blocks form an included angle in a length direction thereof.

Furthermore, both ends of the first sliding slot are the first openings; or, one end of the first sliding slot is the first opening, and an opposite end of the first sliding slot is closed.

Furthermore, the sleeving member includes a first base plate, at least two first position limiting plates arranged on the first base plate, and second position limiting plates arranged on the first base plate. The two first position limiting plates are spaced apart. The second position limiting plate is spaced apart from the first base plate. The first base plate, the two adjacent first position limiting plates, and the second position limiting plates on the two adjacent first position limiting plates surround to form the first sliding slot with the first opening and a second opening.

Furthermore, the second position limiting plate is provided with a plurality of dentate slots for increasing a contact surface with a bed sheet.

Furthermore, the sleeving member also includes a blocking plate. The blocking plate is positioned on one side of the first position limiting plate and connected to the first base plate.

Furthermore, a distance between the two adjacent second position limiting plates gradually increases along a position of one end close to the first opening.

Furthermore, the bracket further includes a first connecting portion. The first sliding block is connected to the supporting member through the first connecting portion.

Furthermore, the first sliding block is plate-shaped and is disposed opposite to the supporting member. The first connecting portion is perpendicular to the supporting member and the first sliding block respectively.

Furthermore, the first connecting portion is connected to a middle position of the first sliding block or connected to a position near the middle of the first sliding block.

Furthermore, the supporting member, the first connecting portion, and the first sliding block are integrally formed by injection molding.

Furthermore, a total number of the supporting members is two, and the two supporting members are arranged vertically and spaced apart.

Furthermore, the bracket further includes a second connecting portion. Two ends of the second connecting portion are connected to the two supporting members respectively.

Furthermore, the supporting member and the bottom plate are integrally formed by injection molding.

Furthermore, the supporting member is detachably connected to the bottom plate.

Furthermore, a detachable structure is provided between the supporting member and the bottom plate. The detachable structure includes a second sliding block and a second sliding slot adapted for use with the second sliding block. The second sliding block is placed inside the second sliding slot when the supporting member is assembled with the bottom plate.

Furthermore, the second sliding block is positioned on the supporting member, and the second sliding slot is positioned on a base. Alternatively, the second sliding block is positioned on the base, and the second sliding slot is positioned in the supporting member.

Furthermore, an upper surface and/or a lower surface of the bottom plate extend vertically at a peripheral position to form a first convex edge for strengthening strength of the bottom plate.

Furthermore, a passing hole is defined in a middle of the bottom plate.

Furthermore, an upper surface and/or a lower surface of the bottom plate extend vertically at a position of a side wall of the passing hole to form a second convex edge for enhancing strength of the bottom plate.

The present invention has the following beneficial effects. In this embodiment, by configuring the first sliding block on the bracket for use with the first sliding slot in the sleeving member, when the bracket is used in conjunction with a bed sheet, the bottom plate is pressed under a mattress, and the supporting member is attached to an outer side wall of the mattress, that is, the first sliding block is exposed on an outer side of the mattress, and the bed sheet is covered on an outer side of the first sliding block. Then, the sleeving member is sleeved on the first sliding block through the first sliding slot, so as to press one part of the bed sheet between the sleeving member and the first sliding block to achieve the fixation of the bed sheet. Compared with the prior art, the sleeving member of this embodiment is not sheet-shaped, and is sleeved on the first sliding block from an outer side, making it less likely for the sleeving member to be pulled apart when a user pulls the bed sheet, thus improving the reliability of the product. Moreover, the sleeving member is not in a long strip shape, which can reduce the packaging volume of the product and facilitate transportation.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
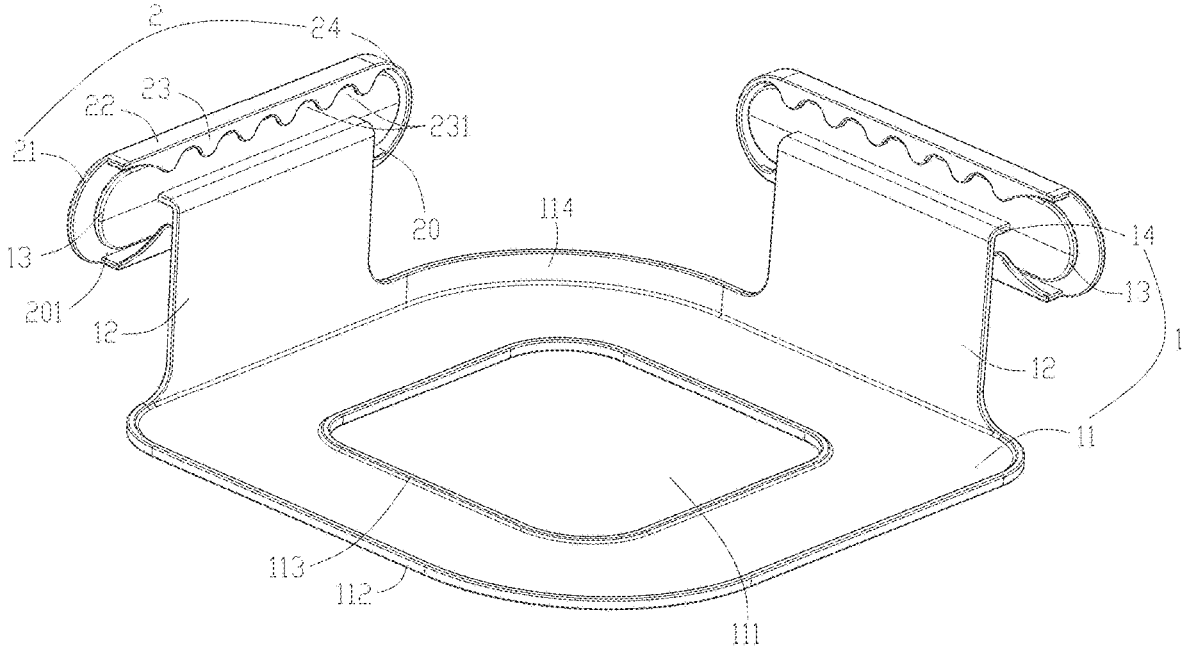
FIG. 1 is a perspective view of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
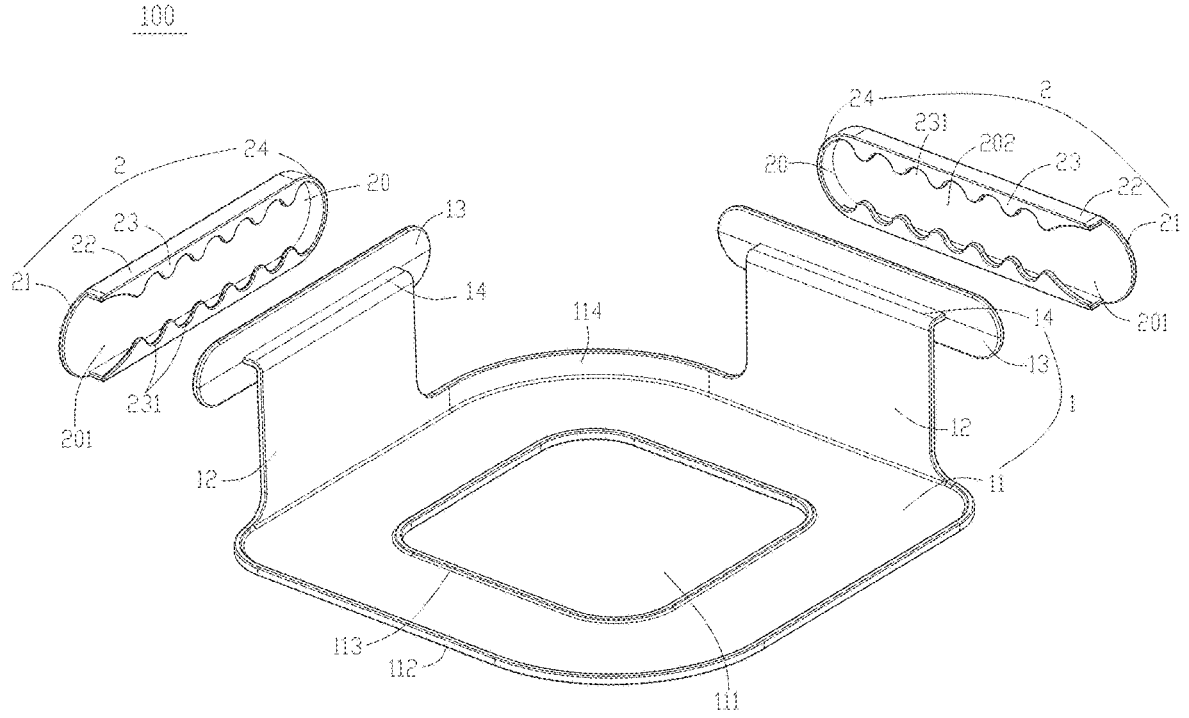
FIG. 2 is an exploded view of the present invention.
Figure 3:
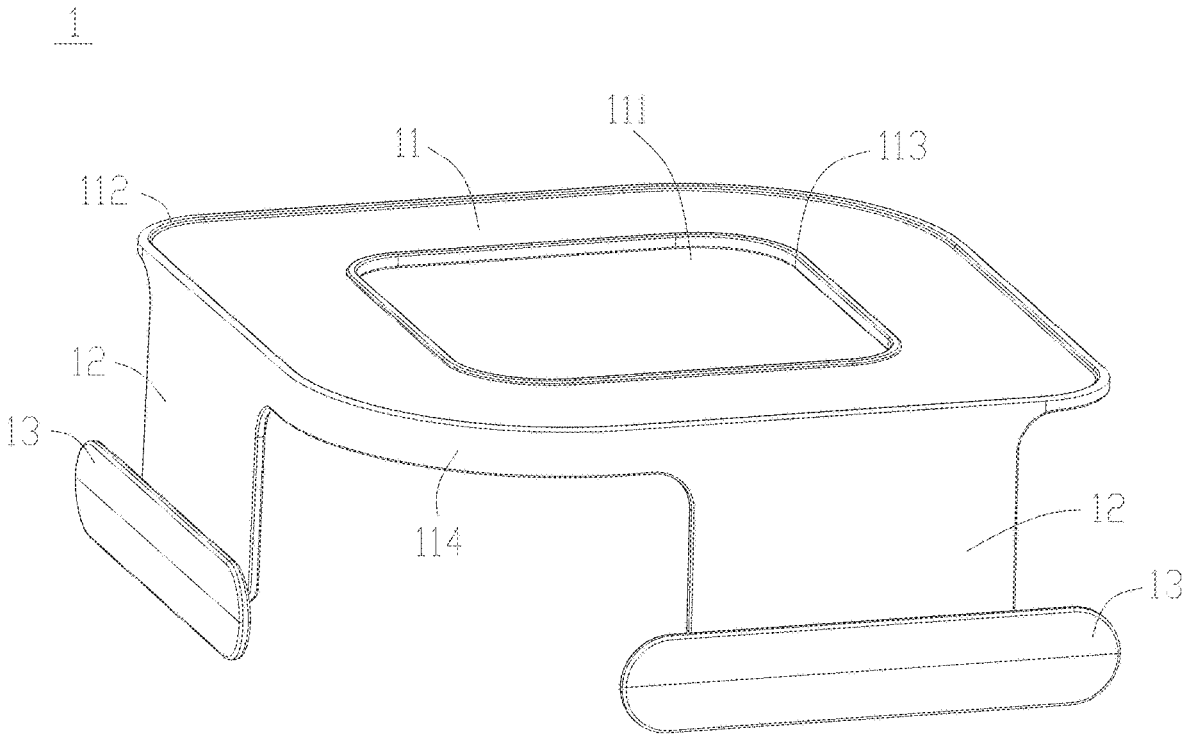
FIG. 3 is a structural diagram of a bracket of the present invention.
Figure 4:
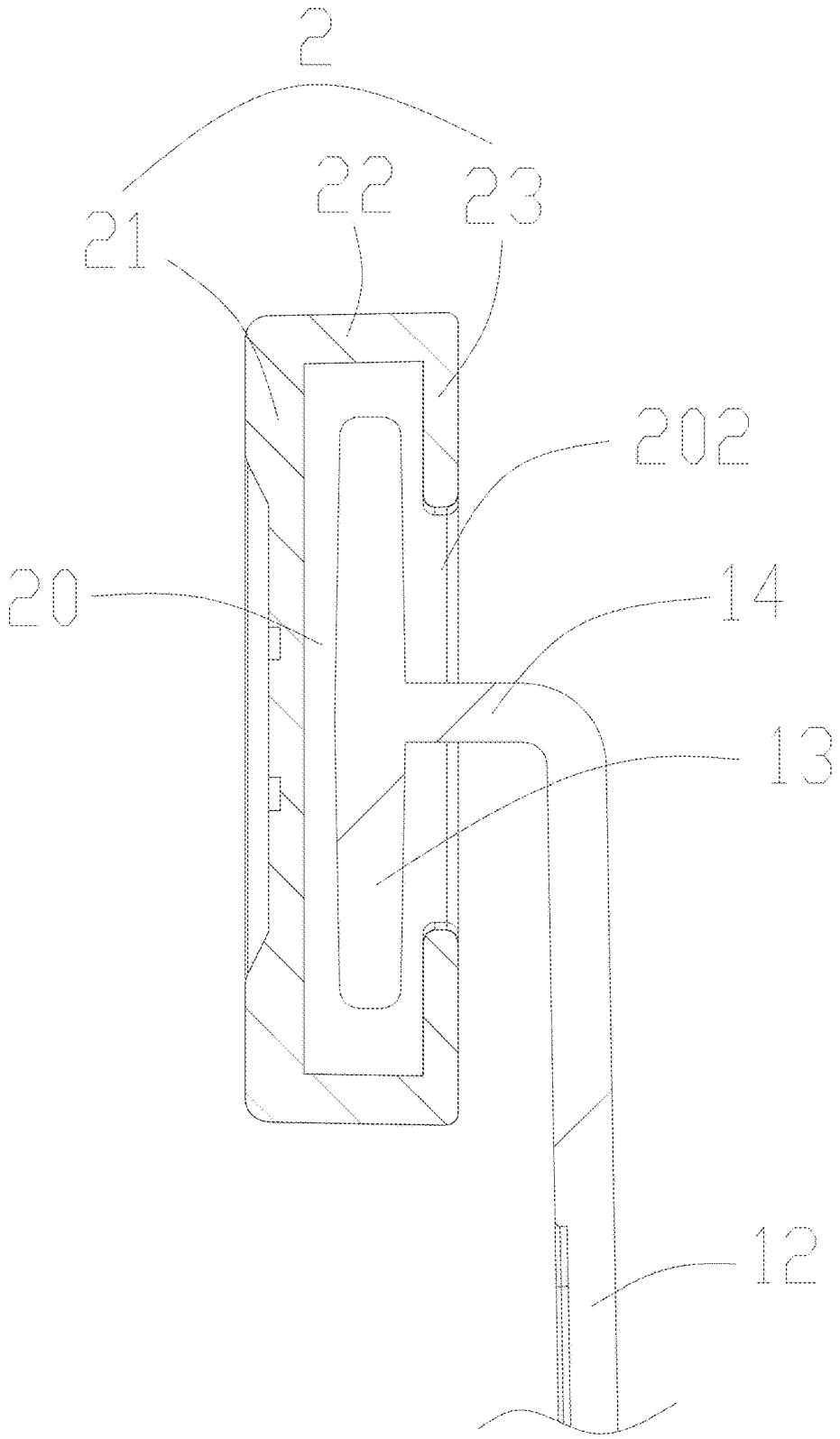
FIG. 4 is a sectional view showing that a sleeving member is used in conjunction with a first sliding block of the present invention.
Figure 5:
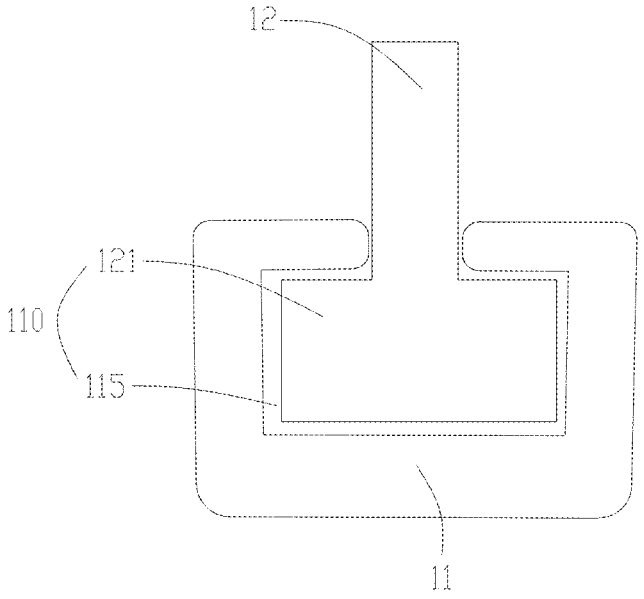
FIG. 5 is a schematic diagram showing that a second sliding block is used in conjunction with a second sliding slot of the present invention.

Referring to FIG. 1 to FIG. 5, a bed sheet holder 100 is provided in an embodiment of the present invention.

The bed sheet holder 100 includes a bracket 1 and a plurality of sleeving members 2. The bracket 1 includes a bottom plate 11, a plurality of supporting members 12 arranged on the bottom plate 11, and a plurality of first sliding blocks 13 arranged on the supporting members 12. A first sliding slot 20 is defined in the sleeving member 2. At least one end of the first sliding slot 20 is a first opening 201. The first sliding block 13 is arranged inside the first sliding slot 20.

In this embodiment, by configuring the first sliding block 13 on the bracket 1 for use with the first sliding slot 20 in the sleeving member 2, when the bracket 1 is used in conjunction with a bed sheet, the bottom plate 11 is pressed under a mattress, and the supporting member 12 is attached to an outer side wall of the mattress, that is, the first sliding block 13 is exposed on an outer side of the mattress, and the bed sheet is covered on an outer side of the first sliding block 13. Then, the sleeving member 2 is sleeved on the first sliding block 13 through the first sliding slot 20, so as to press one part of the bed sheet between the sleeving member 2 and the first sliding block 13 to achieve the fixation of the bed sheet. Compared with the prior art, the sleeving member 2 of this embodiment is not sheet-shaped, and is sleeved on the first sliding block 13 from an outer side, making it less likely for the sleeving member 2 to be pulled apart when a user pulls the bed sheet, thus improving the reliability of the product.

Specifically, in one embodiment, a total number of the sleeving members 2 and a total number of the first sliding blocks 13 are both multiple. Each of the sleeving members 2 is used in conjunction with one of the first sliding blocks 13. At least two of the first sliding blocks 13 are essentially perpendicular in a length direction thereof. Through this structure, at least two of the first sliding blocks 13 can be positioned on two adjacent side surfaces of the mattress respectively, that is, by fixing the bed sheet with the bed sheet holder 100 of this embodiment, the bed sheet can be fixed from two different surfaces at a corner, thereby stably fixing the bed sheet on the mattress. Moreover, the plurality of sleeving members 2 are a plurality of parts, not in a long strip shape, which can reduce the packaging volume of the product and facilitate transportation compared with a strip-shaped sheet body in the prior art.

Of course, in other embodiments, the number of the first sliding block 13 may also be one. Moreover, one first sliding block 13 may be in a straight line shape, or the first sliding block 13 may be continuous and have a certain curvature or V-shaped, etc. A plurality of first sliding blocks 13 can also be arranged in a straight line, or at least two first sliding blocks 13 form an included angle such as an acute angle and an obtuse angle in respective length directions. The positional relationship between the plurality of first sliding blocks 13 is not limited here.

In one embodiment, one end of the first sliding slot 20 is the first opening 201, and an opposite end of the first sliding slot 20 is closed, that is, the sleeving member 2 can only be sleeved onto the first sliding block 13 from one direction. When two sleeving members 2 are used together with two first sliding blocks 13 that are basically in a vertical state or form a certain included angle, and the first openings 201 on the two sleeving members 2 are arranged either close to or far from each other, when the bed sheet is pulled, the two sleeving members 2 will not be pulled in the directions away from their respective first openings 201 at the same time, and at least one of the sleeving members 2 is restricted at a closed end of the first sliding slot 20 to keep the bed sheet fixed, so that the other of the sleeving members 2 can also be prevented from being pulled, thereby effectively fixing the bed sheet and improving the stability of fixing the bed sheet.

In this embodiment, the sleeving member 2 includes a first base plate 21, at least two first position limiting plates 22 arranged on the first base plate 21, and second position limiting plates 23 arranged on the first base plate 21. The two first position limiting plates 22 are spaced apart. The second position limiting plate 23 is spaced apart from the first base plate 21. The first base plate 21, the two adjacent first position limiting plates 22, and the second position limiting plates 23 on the two adjacent first position limiting plates 22 surround to form the first sliding slot 20 with the first opening 201 and a second opening 202. The second opening 202 is used for avoiding the bracket 1, so as to form the first sliding slot 20 used in conjunction with the first sliding block 13.

The sleeving member 2 also includes a blocking plate 24. The blocking plate 24 is positioned on one side of the first position limiting plate 22 and connected to the first base plate 21, so that one end of the first sliding slot 20 is the first opening 201, and an opposite end of the first sliding slot 20 is closed.

In one embodiment, the second position limiting plate 23 is provided with a plurality of dentate slots 231. By using the dentate slot 231, a contact surface between the sleeving member 2 and the bed sheet can be increased, and a friction force between the sleeving member 2 and the bed sheet can be increased. When the bed sheet is pulled, a part of the bed sheet is placed in the dentate slot 231, which can better limit the displacement of the bed sheet. The plurality of dentate slots 231 are designed in a wave shape, with smooth transitions between two adjacent dentate slots 231.

Of course, in other embodiments, both ends of the first sliding slot 20 are the first openings 201, that is, the sleeving member 2 can be sleeved on the first sliding block 13 regardless of direction (irrespective of direction). In this embodiment, the sleeving member 2 does not include the blocking plate 24.

In one embodiment, a distance between the two adjacent second position limiting plates 23 gradually increases along a position of one end close to the first opening 201. This design structure can play a guiding role, so that the first sliding block 13 is conveniently placed in the first sliding slot 20.

In one embodiment, in order to improve the compactness of the structure of the bracket 1, the bracket 1 further includes a first connecting portion 14. The first sliding block 13 is connected to the supporting member 12 through the first connecting portion 14. The first sliding block 13 is connected through the first connecting portion 14, so that the first sliding block 13 is separated from the supporting member 12, and can be used in conjunction with the first sliding slot 20 of the sleeving member 2.

In one embodiment, the first sliding block 13 is plate-shaped and is spaced apart from the supporting member 12. The first connecting portion 14 is perpendicular to the supporting member 12 and the first sliding block 13 respectively, so that the sleeving member 2 can be sleeved on the first sliding block 13 more conveniently.

In one embodiment, the first connecting portion 14 is connected to a middle position of the first sliding block 13 or connected to a position near the middle of the first sliding block 13, so as to improve the structural strength of the first sliding block 13 and the supporting member 12, and also allow the first sliding block 13 to be adapted to two adjacent second position limiting plates 23 in an upper part and a lower part of the first connecting portion 14 for use, in order to better adapt the sleeving member 2 to the first sliding block 13 for use.

Of course, in other embodiments, the first sliding block 13 can also be directly connected to the supporting member 12, that is, positioned at a top portion of the supporting member 12, that is, the first sliding block 13 can be perpendicular to the supporting member 12, which can also enable the first sliding block 13 to be used in conjunction with the first sliding slot 20 in the sleeving member 2.

In one embodiment, the supporting member 12, the first connecting portion 14, and the first sliding block 13 are integrally formed by injection molding, so as to effectively reduce the production process of the bracket 1 and improve production efficiency.

In one embodiment, a total number of the supporting members 12 is two, and the two supporting members 12 are arranged vertically and spaced apart. Through this design, when the bed sheet holder 100 of this embodiment is used for fixing the bed sheet, the two supporting members 12 are respectively attached to two adjacent side walls of the mattress for use, so as to fix the bed sheet from a corner of the mattress, thereby stably fixing the bed sheet on the mattress.

In one embodiment, the bracket 1 further includes a second connecting portion 114. Two ends of the second connecting portion 114 are connected to the two supporting members 12 respectively, and a bottom portion of the second connecting portion 114 is connected to the bottom plate 11, so as to improve the stability of the connection between the two supporting members 12 and enhance the structural stability of the bed sheet holder 100 in this embodiment.

In one embodiment, the supporting member 12 and the bottom plate 11 are integrally formed by injection molding, and the supporting member 12, the first connecting portion 14, and the first sliding block 13 are integrally formed by injection molding, so as to effectively reduce the production process of the bracket 1 and improve production efficiency.

Of course, in other embodiments, the supporting member 12 is detachably connected to the bottom plate 11. In this embodiment, when the bed sheet holder 100 is packaged or transported, the supporting member 12 can be disassembled and separated from the bottom plate 11, so as to reduce packaging volume, lower transportation costs, and facilitate transportation.

In one embodiment, a detachable structure 110 is provided between the supporting member 12 and the bottom plate 11. The detachable structure 110 includes a second sliding block 121 and a second sliding slot 115 adapted for use with the second sliding block 121. The second sliding block 121 is placed inside the second sliding slot 115 to achieve assembly between the supporting member 12 and the bottom plate 11. When the user needs to detach and separate the supporting member 12 from the bottom plate 11, the supporting member 12 may be pulled to slide to disengage the second sliding block 121 from the second sliding slot 115, so as to detach and separate the supporting member 12 from the bottom plate 11. Specifically, the second sliding block 121 is positioned on the supporting member 12, and the second sliding slot 115 is positioned on a base. Alternatively, the second sliding block 121 is positioned on the base, and the second sliding slot 115 is positioned in the supporting member 12. Of course, in other embodiments, the supporting member 12 can also be detachably fixed and connected to the bottom plate 11 using a buckle, a magnetic attraction, a screw, and other methods.

In one embodiment, an upper surface and/or a lower surface of the bottom plate 11 protrude at a peripheral position to form a first convex edge 112, so as to enhance the strength of the structure of the bracket 1.

In one embodiment, a passing hole 111 is defined in a middle of the bottom plate 11 to reduce the raw materials used in the production of the bracket 1 and save costs while ensuring the structural strength of the bracket 1.

In one embodiment, an upper surface and/or a lower surface of the bottom plate 11 protrude at a position of a side wall of the passing hole 111 to form a second convex edge 113, so as to enhance the strength of the structure of the bottom plate 11.

In one embodiment, the upper surface of the bottom plate 11 is provided with a first friction portion for increasing a friction force with the mattress. The first friction portion may be a convex point, convex strip, groove, or rubber pad for increasing the friction force.

In one embodiment, the lower surface of the bottom plate 11 is provided with a second friction portion for increasing a friction force with a bed frame. The second friction portion may be a convex point, convex strip, groove, or rubber pad for increasing the friction force.

In one embodiment, in order to improve the strength of the bottom plate 11, a plurality of reinforcing ribs can also be provided on the bottom plate 11. Moreover, in order to improve the structural strength of the supporting member 12, a plurality of reinforcing ribs can also be installed on the supporting member 12.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A bed sheet holder, comprising:

a bracket; and a plurality of sleeving members;

wherein the bracket comprises a bottom plate, a plurality of supporting members arranged on the bottom plate, and a plurality of first sliding blocks arranged on the supporting members;

a first sliding slot is defined in the sleeving member; at least one end of the first sliding slot is a first opening; and the first sliding block is arranged inside the first sliding slot;

wherein the sleeving member comprises a first base plate, at least two first position limiting plates arranged on the first base plate, and second position limiting plates arranged on the first base plate; the two first position limiting plates are spaced apart; the second position limiting plate is spaced apart from the first base plate; and the first base plate, the two adjacent first position limiting plates, and the second position limiting plates on the two adjacent first position limiting plates surround to form the first sliding slot with the first opening and a second opening;

wherein the sleeving member also comprises a blocking plate; and the blocking plate is positioned on one side of the first position limiting plate and connected to the first base plate.

2. The bed sheet holder according to claim 1, wherein a total number of the sleeving members and a total number of the first sliding blocks are both multiple; each of the sleeving members is used in conjunction with one of the first sliding blocks; and at least two of the first sliding blocks form an included angle in a length direction thereof.

3. The bed sheet holder according to claim 2, wherein the bracket further comprises a first connecting portion; and the first sliding block is connected to the supporting member through the first connecting portion.

4. The bed sheet holder according to claim 3, wherein the first sliding block is plate-shaped and is disposed opposite to the supporting member; and the first connecting portion is perpendicular to the supporting member and the first sliding block respectively.

5. The bed sheet holder according to claim 4, wherein the first connecting portion is connected to a middle position of the first sliding block or connected to a position near the middle of the first sliding block.

6. The bed sheet holder according to claim 5, wherein the supporting member, the first connecting portion, and the first sliding block are integrally formed by injection molding.

7. The bed sheet holder according to claim 2, wherein a total number of the supporting members is two, and the two supporting members are arranged vertically and spaced apart.

8. The bed sheet holder according to claim 7, wherein the bracket further comprises a second connecting portion; and two ends of the second connecting portion are connected to the two supporting members respectively.

9. The bed sheet holder according to claim 2, wherein an upper surface and/or a lower surface of the bottom plate extend vertically at a peripheral position to form a first convex edge for strengthening strength of the bottom plate.

10. The bed sheet holder according to claim 2, wherein a passing hole is defined in a middle of the bottom plate.

11. The bed sheet holder according to claim 10, wherein an upper surface and/or a lower surface of the bottom plate extend vertically at a position of a side wall of the passing hole to form a second convex edge for enhancing strength of the bottom plate.

12. The bed sheet holder according to claim 1, wherein both ends of the first sliding slot are the first openings; or, one end of the first sliding slot is the first opening, and an opposite end of the first sliding slot is closed.

13. The bed sheet holder according to claim 1, wherein the supporting member and the bottom plate are integrally formed by injection molding.

14. The bed sheet holder according to claim 1, wherein the supporting member is detachably connected to the bottom plate.

15. The bed sheet holder according to claim 14, wherein a detachable structure is provided between the supporting member and the bottom plate; the detachable structure comprises a second sliding block and a second sliding slot adapted for use with the second sliding block; and the second sliding block is placed inside the second sliding slot when the supporting member is assembled with the bottom plate.

16. The bed sheet holder according to claim 15, wherein the second sliding block is positioned on the supporting member, and the second sliding slot is positioned on a base; alternatively, the second sliding block is positioned on the base, and the second sliding slot is positioned in the supporting member.

17. The bed sheet holder according to claim 1, wherein the second position limiting plate is provided with a plurality of dentate slots for increasing a contact surface with a bed sheet.

18. The bed sheet holder according to claim 1, wherein a distance between the two adjacent second position limiting plates gradually increases along a position of one end close to the first opening.

* * * * *